US008306825B2

(12) United States Patent
Nakashima et al.

(10) Patent No.: US 8,306,825 B2
(45) Date of Patent: Nov. 6, 2012

(54) VOICE GUIDANCE SYSTEM FOR VEHICLE

(75) Inventors: Kazuhiro Nakashima, Kariya (JP); Kenichi Ogino, Toyota (JP); Kentaro Teshima, Kariya (JP); Takeshi Kumazaki, Okazaki (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 1187 days.

(21) Appl. No.: 12/099,245

(22) Filed: Apr. 8, 2008

(65) Prior Publication Data

US 2008/0249780 A1 Oct. 9, 2008

(30) Foreign Application Priority Data

Apr. 9, 2007 (JP) ..... 2007-102168

(51) Int. Cl.
*G10L 21/00* (2006.01)

(52) U.S. Cl. ..... 704/275; 704/273; 704/274

(58) Field of Classification Search ..... 704/270.1
See application file for complete search history.

(56) References Cited

U.S. PATENT DOCUMENTS

| | | | | |
|---|---|---|---|---|
| 4,797,924 | A * | 1/1989 | Schnars et al. | 704/275 |
| 5,704,008 | A * | 12/1997 | Duvall, Jr. | 704/273 |
| 5,777,571 | A * | 7/1998 | Chuang | 341/176 |
| 6,140,939 | A * | 10/2000 | Flick | 340/12.28 |
| 6,351,698 | B1 * | 2/2002 | Kubota et al. | 701/51 |
| 6,496,107 | B1 * | 12/2002 | Himmelstein | 340/426.1 |
| 6,701,095 | B1 | 3/2004 | Fujimoto et al. | |
| 6,950,613 | B2 | 9/2005 | Fujimoto et al. | |
| 6,952,155 | B2 * | 10/2005 | Himmelstein | 340/5.52 |
| 7,146,111 | B2 | 12/2006 | Fujimoto et al. | |
| 7,161,476 | B2 * | 1/2007 | Hardman et al. | 340/442 |
| 7,202,775 | B2 * | 4/2007 | Yezersky et al. | 340/426.1 |
| 7,212,966 | B2 * | 5/2007 | Kyomitsu | 704/233 |

(Continued)

FOREIGN PATENT DOCUMENTS

JP 07-7295 1/1995

(Continued)

OTHER PUBLICATIONS

Japanese Office Action dated Mar. 3, 2009, issued in corresponding Japanese Application No. 2007-102168, with English translation.

(Continued)

*Primary Examiner* — Pierre-Louis Desir
*Assistant Examiner* — Matthew Baker
(74) *Attorney, Agent, or Firm* — Nixon & Vanderhye PC

(57) ABSTRACT

A voice guidance system for a vehicle includes a transmitter, a tuner, a touch sensor, a smart ECU, a D-seat speaker, and a P-seat speaker, which are all mounted in a vehicle. It is used for an in-vehicle system, such as a smart entry system, which performs intercommunication with a portable unit. In this guidance system, a smart ECU stores in a memory information indicating that a user has performed predetermined operation with the smart entry system. When it is determined that a user will use the smart entry system, the following processing is performed: voice guidance about the operation procedures for the system is outputted from a driver seat speaker or a passenger seat speaker when information indicating that the user has performed the predetermined operation in the past is not stored in the memory; and voice guidance is disabled when information indicating that the user has performed the predetermined operation is stored.

4 Claims, 4 Drawing Sheets

U.S. PATENT DOCUMENTS

| | | | | |
|---|---|---|---|---|
| 7,272,793 | B2 | 9/2007 | Mutsuno et al. | |
| 7,349,722 | B2 * | 3/2008 | Witkowski et al. | 455/569.2 |
| 7,516,065 | B2 * | 4/2009 | Marumoto | 704/215 |
| 7,516,072 | B2 * | 4/2009 | Campbell et al. | 704/270 |
| 7,548,491 | B2 * | 6/2009 | Macfarlane | 367/198 |
| 8,050,926 | B2 * | 11/2011 | Huang | 704/258 |
| 2001/0020213 | A1 * | 9/2001 | Hatano | 701/207 |
| 2002/0067245 | A1 * | 6/2002 | Campbell et al. | 340/5.64 |
| 2003/0065516 | A1 * | 4/2003 | Hitotsumatsu | 704/275 |
| 2003/0231550 | A1 * | 12/2003 | Macfarlane | 367/198 |
| 2004/0091123 | A1 * | 5/2004 | Stark et al. | 381/86 |
| 2004/0143437 | A1 * | 7/2004 | Hanood | 704/258 |
| 2005/0128106 | A1 * | 6/2005 | Nakaishi et al. | 340/988 |
| 2005/0275505 | A1 * | 12/2005 | Himmelstein | 340/5.8 |
| 2006/0020472 | A1 * | 1/2006 | Mitsui | 704/275 |
| 2006/0074684 | A1 * | 4/2006 | Yoshida et al. | 704/271 |
| 2006/0217068 | A1 * | 9/2006 | Angelopoulos | 455/63.1 |
| 2007/0006081 | A1 * | 1/2007 | Maehata et al. | 715/727 |
| 2007/0082706 | A1 * | 4/2007 | Campbell et al. | 455/563 |
| 2008/0103781 | A1 * | 5/2008 | Wasson et al. | 704/277 |
| 2008/0169899 | A1 * | 7/2008 | Bauman et al. | 340/5.23 |
| 2009/0089065 | A1 * | 4/2009 | Buck et al. | 704/275 |

FOREIGN PATENT DOCUMENTS

| | | |
|---|---|---|
| JP | 2000-104429 | 4/2000 |
| JP | 2001-082976 | 3/2001 |
| JP | 2007-062494 | 3/2007 |
| JP | 2007-076496 | 3/2007 |
| JP | 2008-3562 | 1/2008 |

OTHER PUBLICATIONS

Chinese Office Action dated Feb. 5, 2010, issued in corresponding Chinese Application No. 200810089933.7, with English translation.

Korean Office Action dated Mar. 30, 2012, issued in corresponding Korean Application No. 10-2010-54722, with English translation.

* cited by examiner

VOICE GUIDANCE SYSTEM FOR VEHICLE

CROSS REFERENCE TO RELATED APPLICATION

This application is based on and incorporates herein by reference Japanese Patent Application No. 2007-102168 filed on Apr. 9, 2007.

FIELD OF THE INVENTION

The present invention relates to a voice guidance system for a vehicle that provides voice guidance about an operation procedure for an in-vehicle system.

BACKGROUND

Conventionally, various in-vehicle systems have been mounted in vehicles. For examples, JP 2000-104429A discloses a smart entry system as an example of these in-vehicle systems.

In recent years, in-vehicle systems have been increasingly complicated. To use an in-vehicle system, a user must memorize operation procedures by hearing an explanation from a dealer or reading a manual. If a user takes an erroneous operation procedure, the user is alerted by a buzzer or a display. Thereafter, however, the user must read a manual to cope with the alert.

As in-vehicle systems are complicated, manuals become voluminous. It is difficult to find the description of a desired operation procedure. To let a user know operation procedures, consequently, a voice guidance system is used to provide guidance about the operation procedures by voice. However, if this voice guidance is always outputted in a certain mode, a user who is already acquainted well with the operation procedures will be annoyed. It will also annoy surrounding people depending on the environment (time, location, noise) around the vehicle.

SUMMARY

Consequently, it is an object of the invention to provide a voice guidance system for a vehicle capable of providing appropriate voice guidance.

According to a first aspect of the invention, a voice guidance system for a vehicle checks whether a user has performed a predetermined operation with an in-vehicle system and stores the result of this determination. When the user uses the in-vehicle system again, the following processing is performed on a case-by-case basis as follows. In cases where it has not been stored that the user performed the predetermined operation, voice guidance is outputted about the predetermined operation of the in-vehicle system. In cases where it has been stored that the user had already performed the predetermined operation, voice guidance is aborted. Thus, voice guidance can be stopped for a user who can appropriately operate the in-vehicle system and voice guidance can be provided only for a user who cannot, and thus appropriate voice guidance can be provided. When it is determined that a user is not carrying out an appropriate operation, the stored result of past determination is erased even though user has appropriately operated the in-vehicle system before. Thus, when a mistake is made in operation, voice guidance can be again provided.

According to a second aspect of the invention, a voice guidance system for a vehicle is used for an in-vehicle system that controls vehicle-mounted equipment. In this in-vehicle system, intercommunication is performed and multiple portable units send back response signals containing respective different ID codes in response to a request signal transmitted from a vehicle unit. The vehicle unit receives a response signal from any of the multiple portable units, verifies the ID code contained in the response signal against registered codes entered beforehand, and controls the vehicle-mounted equipment according the result of the verification. The voice guidance system for a vehicle checks whether a user is to use the in-vehicle system. When it is determined that the in-vehicle system is to be used, the mode of voice guidance outputted by voice is changed from portable unit to portable unit. In addition, the position of a portable unit is detected, and voice guidance is provided in the detected position. Thus, voice guidance can be outputted in a position in proximity to the user.

DETAILED DESCRIPTION OF THE EMBODIMENT

First Embodiment

Figure 1:
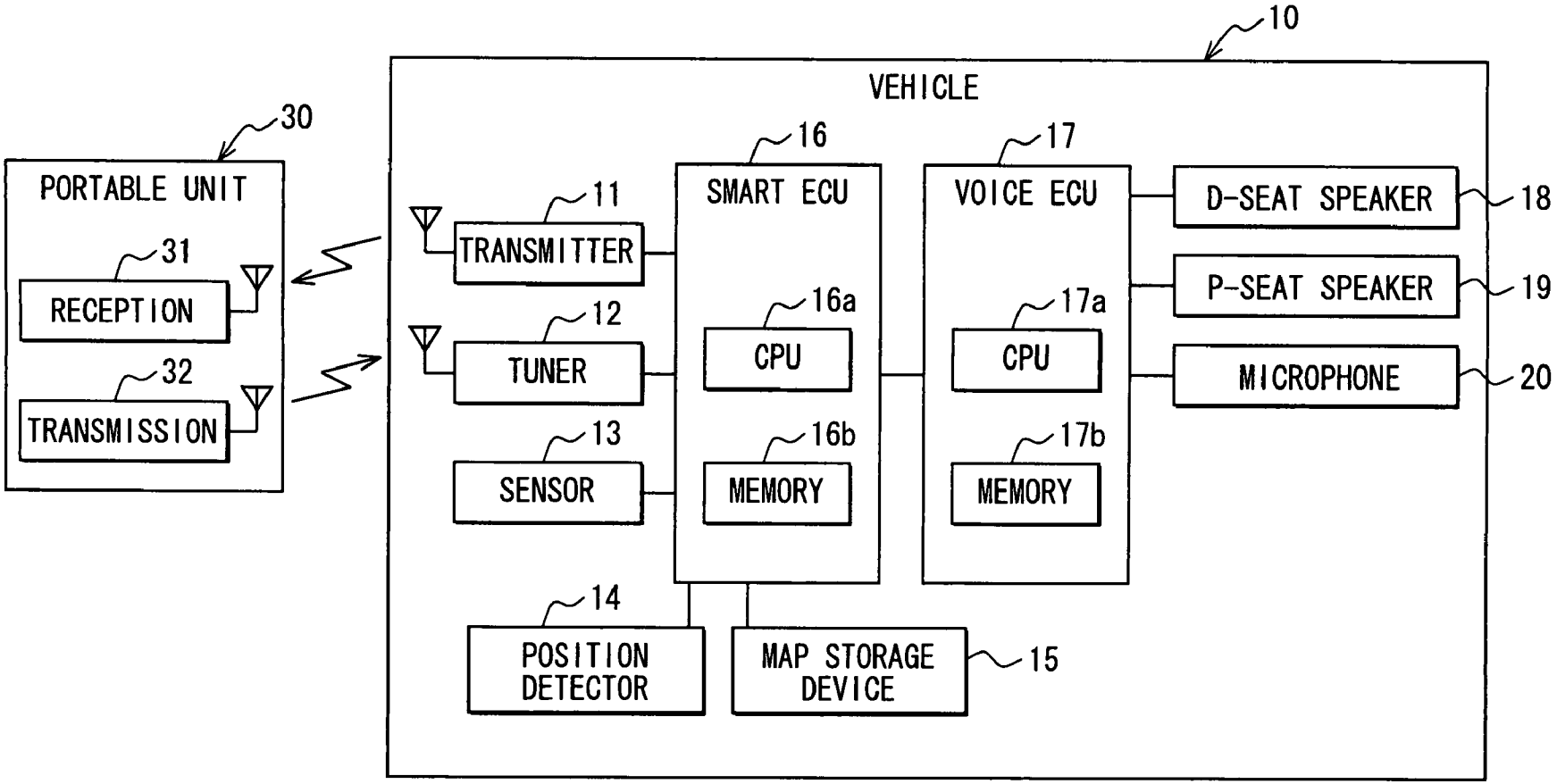
FIG. 1 is a block diagram illustrating a voice guidance system for a vehicle according to a first embodiment of the present invention.

In this embodiment illustrated in FIG. 1, a voice guidance system for a vehicle is used for a smart entry system (in-vehicle system). That is, the voice guidance system for a vehicle provides voice guidance about operation procedures for the smart entry system.

The voice guidance system for a vehicle includes: a transmitter 11, a tuner (receiver) 12, a touch sensor 13, a position detector 14, a map storage device 15, a smart ECU 16, a voice ECU 17, a D-seat speaker 18, a P-seat speaker 19, and a microphone 20, which are all mounted in a vehicle 10; and a portable unit (electronic key) 30 that can be carried by a user and performs intercommunication with the transmitter 11 and the tuner 12 in the vehicle 10.

In this smart entry system, the smart ECU 16 (CPU 16*a*) controls the lock/unlock state of each door (not shown) of the vehicle 10 based on the following: the result of verification of an ID code by intercommunication (two-way communication) between the smart ECU 16 (transmitter 11 and tuner 12) and the portable unit 30 (reception unit 31 and transmission unit 32).

The transmitter 11 is an outside transmitter provided on each door of the vehicle 10, that is, outside a vehicle compartment. Each transmitter 11 transmits a request signal based on a transmission instruction signal from the smart ECU 16. The range of the request signal from the transmitter 11 is set to, for example, 0.7 to 1.0 meter or so. When the vehicle 10 is parked, therefore, a detection area corresponding to the range of the request signal is formed around each door of the vehicle 10. Thus, the approach of the user (holder) of the portable unit 30 to the vehicle 10 can be detected.

The smart ECU 16 is also connected with an inside transmitter (not shown) provided in the vehicle compartment. The detection area of the inside transmitter is so set that the interior of the vehicle compartment is covered to detect whether the portable unit 30 is in the vehicle compartment.

The tuner 12 is brought into a state in which it can receive a response signal in synchronization with the output of a transmission instruction signal to the transmitter 11, and receives a response signal transmitted from the portable unit 30. The response signal received by the tuner 12 is outputted to the smart ECU 16. The smart ECU 16 determines whether to carry out control on the lock/unlock state of the doors based on the ID code contained in the received response signal.

The touch sensor 13 is provided on the door outside handle (door handle) of each door of the vehicle 10. It detects that the user of the portable unit 30 has touched a door handle and outputs a resulting detection signal to the smart ECU 16. Each door is provided with a door ECU, a locking mechanism, and the like though they are not shown in the figure. If the result of verification of the ID code transmitted from the portable unit 30 meets predetermined correspondence relation and this touch sensor 13 is touched, the following takes place: the door ECU and locking mechanism of each door are actuated according to an instruction signal from the smart ECU 16. Each door can be locked by this operation.

The position detector 14 detects the position of the vehicle 10 and includes: a geomagnetism sensor for detecting the azimuth of the traveling direction of the vehicle; a gyro sensor for detecting the angular speed of the vehicle around the vertical direction; a distance sensor for detecting the travel distance of the vehicle; a GPS receiver for a global positioning system (GPS) for detecting the present position of the vehicle based on radio waves from GPS satellites; and the like. The position detector 14 outputs a signal indicating the detected position of the vehicle to the smart ECU 16. These sensors have respective errors different in nature and they are so constructed that multiple sensors are used by complementing them one another. The position detector 14 may be constructed of some of the foregoing depending on the accuracy of each sensor.

The map storage device 15 stores a map database comprised of: road-related data including road data, landmark data, background data, and the like used for map display, route guidance, and the like; and map data including search data on facility names, telephone numbers, and the like used in destination search, nearby facility search, and the like. As the storage medium of the map storage device 15, a rewritable HDD or the like is used from the viewpoint of the volume of data and ease of use. When the vehicle 10 is mounted with an automobile navigation system, the position detector and the map storage device of the automobile navigation system may be used for the above purposes.

The smart ECU 16 is a computer provided with a CPU 16*a*, a memory 16*b*, and the like. The CPU 16*a* performs various processing according to programs pre-stored in the memory 16*b* or the like. For example, the CPU 16*a* controls the lock/unlock state of each door as described above. Further, when the vehicle is parked and the doors are locked, the CPU 16*a* periodically outputs a request signal as a transmission request signal to the transmitter 11 at intervals set to as short a time as 0.3 seconds or so. In addition, the smart ECU 16 outputs an instruction signal indicating the mode of voice guidance to the voice ECU 17 described later.

The CPU 16*a* checks whether a user has performed predetermined operation with the smart entry system (operation result checking means) and further stores the result of the determination in the memory 16*b* as a learning history (determination result storing means). More specifically, when the CPU 16*a* determines that the user has performed predetermined operation with the smart entry system, it stores information indicating that the user has appropriately performed operation (learning history means) in the memory 16*b*. When information indicating that the user has appropriately performed operation (learning history) is stored in the memory 16*b*, the CPU 16*a* operates as follows. When it determines that the user has not performed predetermined operation with the smart entry system, it erases the information from the memory 16*b*. Further, the smart ECU 16 changes the mode of voice guidance (changing means) based on the result of determination of whether a user stored in the memory 16*b* has performed predetermined operation. (It changes the mode of voice guidance based on whether the user performed predetermined operation with the smart entry system in the past.) In other words, the smart ECU 16 changes the mode of voice guidance based on whether the user has the operation procedures for the smart entry system in mind. Further, in the smart ECU 16, there are stored multiple portable units (main key and sub key), as described later. When a learning history is stored in the memory 16*b*, the learning history is stored on a unit-by-unit basis.

In the memory 16*b*, further, information indicating the mode of voice guidance is stored in correlation to each portable unit (in-vehicle mode storing means). That is, voice guidance can be customized on a unit-by-unit basis. This can be done using an operating device (not shown), a display (not shown), and the like. Examples of the mode of voice guidance include the disablement of voice guidance, the execution of voice guidance, and the like. The following case will be adopted as an example: a case where information indicating that voice guidance will be disabled is correlated to a main key (key 1) and information indicating that voice guidance will be executed is correlated to a sub key (key 2).

When an engine start switch (not shown) is operated, the smart ECU 16 outputs a request signal to the inside transmitter. The smart ECU 16 also includes a clock (not shown) for checking the present time and the like.

The voice ECU 17 is a computer provided with a CPU 17*a*, a memory 17*b*, and the like. The CPU 17*a* performs various processing according to programs pre-stored in the memory 17*b*. For example, the CPU 17*a* causes the D-seat (driver seat) speaker 18 and/or the P-seat (passenger seat) speaker 19 to output voice based on an instruction signal from the smart ECU 16 and thereby provides voice guidance. In the memory 17*b*, there is stored voice data for providing voice guidance. The D-seat speaker 18 and the P-seat speaker 19 are used to provide voice guidance. They can respectively output voice to outside the vehicle on the D-seat side and on the P-seat side. The microphone 20 is installed at a predetermined part of the vehicle for detecting the magnitude of sound around the vehicle.

The portable unit 30 includes: the reception unit 31 that receives a request signals from each transmitter 11 mounted in the vehicle 10; and the transmission unit 32 that transmits response signals containing its ID code and the like in response to the reception of the request signal. The portable unit 30 is provided with a controller, not shown. The controller is connected to the reception unit 31 and the transmission unit 32 and performs various control processing. Specifically, the controller checks whether a request signal has been received based on a reception signal from the reception unit 31, and generates a response signal containing an ID code and the like and causes the transmission unit 32 to transmit it.

Multiple portable units 30 can be registered in the smart ECU 16. That is, when the portable unit 30 is taken as the main key, one or more sub keys having the same construction as that of the portable unit 30 can be provided. The multiple portable units (main key, sub key) send back response signals containing different ID codes in response to a request signal and thereby carry out intercommunication between them and the smart ECU 16. It is assumed in this embodiment that both a portable unit 30 (key 1) as the main key and a portable unit (key 2, not shown) as a sub key are registered in the smart ECU 16.

The processing and operation performed by a voice guidance system for a vehicle in this embodiment is described below. First, the processing of checking whether voice guidance should be provided by the voice guidance system for a vehicle is described with reference to FIG. 2.

At step S10, first, the CPU 16*a* confirms (checks) whether a learning history is stored in the memory 16*b*. That is, the CPU 16*a* confirms whether information indicating that a user has appropriately operated the smart entry system before is stored. (In the description of this embodiment, the above information is information indicating that the user has appropriately performed door locking operation.) This learning history, that is, information indicating the user has appropriately operated the smart entry system was stored in the memory 16*b* when the user appropriately operated the smart entry system in the past.

At step S11, the CPU 16*a* checks whether the learning history is stored in the memory 16*b*. When the CPU determines that it is stored, the CPU proceeds to step S12. When the CPU determines it is not stored, the CPU proceeds to step S14. Whether the learning history is stored in the memory 16*b* is checked at steps S10 and S11 in order to determine whether the mode of voice guidance should be changed.

At step S12, the CPU 16*a* checks whether the user has performed operation. When the CPU determines that the user has performed operation, it proceeds to step S13. When the CPU determines that the user has not performed operation, it proceeds to step S14. That is, when the learning history is stored in the memory 16*b*, the CPU 16*a* outputs information asking whether to disable voice guidance through the display (not shown) or the like.

When an operating signal indicating that voice guidance should be disabled is outputted from the operating device (not shown) or the like operated by the user, the CPU 16*a* proceeds to step S13 to disable voice guidance. When the signal is not outputted, the CPU proceeds to step S14 to enable voice guidance (not to disable voice guidance). As described above, since the user is allowed to determine whether to disable voice guidance, user can recognize that voice guidance will be disabled.

However, this step (step S12) for asking the user whether to disable voice guidance may be omitted. If the learning history is stored in the memory 16*b* in this case, voice guidance may be automatically disabled. (When a YES determination is made at step S11, the CPU proceeds to step S13.) That is, voice guidance may be automatically disabled or may be disabled according to an instruction from the user.

At step S13, the CPU 16*a* disables voice guidance. It is clearly not appropriate to provide a user acquainted with predetermined operation procedures with voice guidance about the operation procedures. If voice guidance about predetermined operation procedures is provided even though the user is familiar with the operation procedures, user will feel annoyed. When the learning history is stored in the memory 16*b* as described above, consequently, the following measure is taken: it is assumed that the user is familiar with the predetermined operation procedures for the smart entry system and hence voice guidance is disabled.

At step S14, the CPU 16*a* enables voice guidance. When the learning history is not stored in the memory 16*b*, the following measure is taken: it is assumed that the user is not familiar with the predetermined operation procedures for the smart entry system and voice guidance is enabled.

The operation and processing performed by the voice guidance system for a vehicle in door lock processing in the smart entry system is described next with reference to FIG. 3.

At step S20, first, the CPU 16*a* checks by referring to a courtesy switch (not shown) or the like whether the door is opened or closed. At step S21, the CPU 16*a* checks whether change from door open (the open state of the door) to door closed (the closed state of the door) has occurred. When it determines that change from door-open to door-closed has occurred, it proceeds to step S22. When it determines that change from door-open to door-closed has not occurred, it returns to step S20.

At step S22, the CPU 16*a* performs outside verification. More specifically, the CPU 16*a* causes the transmitter 11 to transmit a request signal outward and further causes a tuner 12 to receive a response signal from the portable unit 30. Then, it performs the outside verification based on the ID code contained in the received response signal. When at step S23, the CPU 16*a* determines the result of the verification performed at step S22 is OK (the ID code contained in the received response signal meets the predetermined correspondence relation), it proceeds to step S24. When it determines that the result of the verification is not OK, it returns to step S20. When the change from door-open to door-closed has occurred and the result of outside verification is OK, the CPU 16*a* assumes that the smart entry system (door locking function) will be used. That is, the CPU 16*a* determines whether the smart entry system is to be used (use checking means) according to whether the change from door-open to door-closed has occurred and according to whether the result of outside verification is OK.

At step S24, the CPU 16*a* checks whether it is daytime based on time of day information from the clock or the GPS. When it determines that it is daytime, it proceeds to step S25. When it determines that it is not daytime, it proceeds to step S29. At step S25, the CPU 16*a* checks whether the present position of the vehicle 10 is located outdoors based on information from the position detector 14 and the map storage device 15. When it determines that the present position is located outdoors, it proceeds to step S26. When it determines that the present position is not located outdoors (is located indoors), it proceeds to step S28. At step S26, the CPU 17*a* checks whether noise is present around the vehicle 10 using the microphone 20. When the detection signal detected from the microphone 20 is higher than a reference value, it determines that there is noise and proceeds to step S27. When the detection signal detected from the microphone 20 is not higher than the reference value, it determines that there is not noise and proceeds to step S28.

The purpose of the determinations made at steps S24 to 26 is as follows. The environment around the vehicle 10 is determined (environment determining means) and it is thereby determined with which volume, normal volume, large volume, or small volume, voice guidance should be outputted in the environment around the vehicle 10. At step S27, the CPU 17*a* sets the volume of output voice for providing voice guidance to large (changing means). This is a case where it is daytime and the present position is outdoors and there is noise. In this case, the vehicle 10 is in such an environment that: if voice guidance is not outputted with large volume, it is difficult for the user to perceive it; and even though voice guidance is outputted with large volume, surrounding people are not likely to be annoyed. Therefore, the volume of output voice for voice guidance is increased.

At step S28, the CPU 17*a* sets the volume of output voice for providing voice guidance to normal or medium (changing means). This is a case where it is daytime and the present position is indoors; or it is daytime and the present position is outdoors and there is not noise. In this case, the vehicle 10 is in such an environment that: if voice guidance is not outputted with normal volume, it is difficult for the user to perceive it; and even though voice guidance is outputted with normal volume, surrounding people are not likely to be annoyed. Therefore, the volume of output voice for voice guidance is set to normal. When it is determined at step S25 that the vehicle 10 is not positioned outdoors, the CPU 16*a* instructs the CPU 17*a* to set the volume of output voice for voice guidance to normal.

At step S29, the CPU 17*a* sets the volume of output voice for voice guidance to small (changing means). At step S29 in this case, it is nighttime and the vehicle 10 is in such an environment that voice guidance should not be outputted with so large volume. Therefore, the volume of output voice for voice guidance is reduced. When it is determined at step S24 that it is not daytime, the CPU 16*a* instructs the CPU 17*a* to set the volume of output voice for voice guidance to small.

Voice guidance can be provided with volume appropriate to the environment around the vehicle by varying the sound volume of outputted voice guidance based on the environment around the vehicle.

At step S30, subsequently, the CPU 16*a* checks whether the portable unit that transmitted the response signal in the verification performed at step S22 is the main key (key 1) or the sub key (key 2). In this embodiment, the mode of voice guidance is changed from portable unit to portable unit. Therefore, the purpose of the determination made at step S30 is to determine the mode of voice guidance corresponding to the portable unit used this time.

In this example of this embodiment, the main key (key 1) is so set that voice guidance will not be provided. Therefore, when it is determined at step S30 that the portable unit is key 1, voice guidance is not provided and the CPU proceeds to step S37. In this example of this embodiment, the sub key (key 2) is so set that voice guidance will be provided. Therefore, when it is determined at step S30 that the portable unit is key 2, the CPU proceeds to step S31. As described above, the mode of voice guidance can be changed on a unit-by-unit basis by the user or the like customizing voice guidance with respect to each portable unit. Therefore, it is possible to provide voice guidance appropriate to each user.

Figure 2:
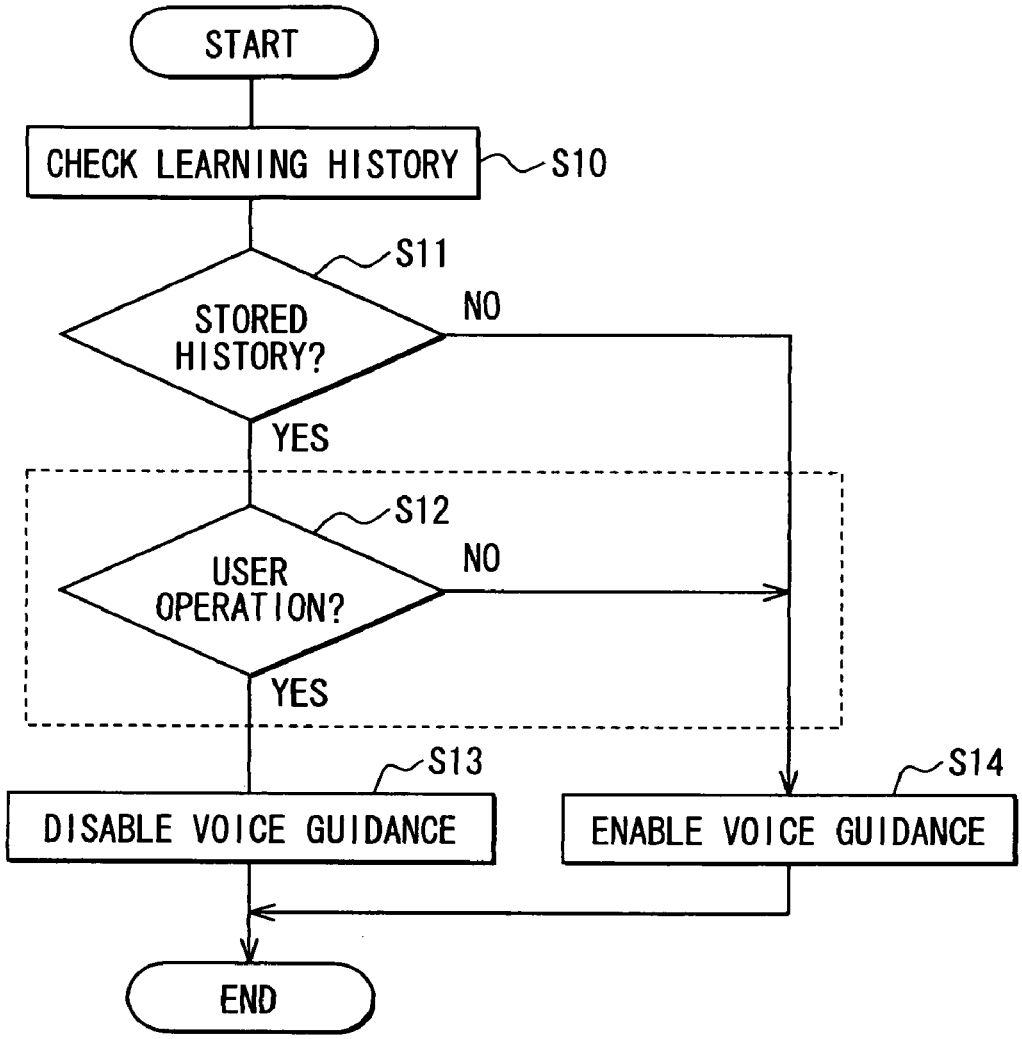
FIG. 2 is a flowchart illustrating voice guidance determination processing in the first embodiment.

At step S31, the CPU 16*a* checks that voice guidance is disabled with respect to key 2 by the processing illustrated in the flowchart of FIG. 2. When there is a learning history correlated to key 2 in the memory 16*b*, voice guidance is disabled with respect to key 2. When at step S32 the CPU 16*a* determines that voice guidance is disabled with respect to key 2, it does not provide voice guidance and proceeds to step S37. When it determines that voice guidance is not disabled with respect to key 2, it proceeds to step S34 and the following steps to provide voice guidance. As described above, the mode of voice guidance is changed from portable unit to portable unit by learning (learning history). Therefore, it is possible to provide voice guidance appropriate to each user.

More specifically, in this embodiment, the sound volume of voice guidance is varied according to the environment around the vehicle. In addition, the mode of voice guidance is changed by customizing voice guidance with respect to each portable unit (key 1, key 2). Further, the mode of voice guidance is also changed with respect to each portable unit (key 1, key 2) by learning.

At step S33, the CPU 16*a* detects the position (D-seat side or P-seat side) of key 2 (portable unit). At step S34, the CPU 16*a* checks whether key 2 is positioned on the P-seat side or on the D-seat side based on the result of the determination made at step S33. When it determines that key 2 is positioned on the D-seat side, it proceeds to step S35. When it determines that key 2 is positioned on the P-seat side, it proceeds to step S36.

At step S35, the CPU 16*a* outputs an instruction signal to the voice ECU 17 and thereby causes the D-seat speaker 18 to output voice guidance with the volume set at any of step S27 to step S29 (voice outputting means). An example of voice guidance outputted at this time may be "Touch the handle to lock the door."

At step S36, the CPU 16*a* outputs an instruction signal to the voice ECU 17 and thereby causes the P-seat speaker 19 to output voice guidance with the volume set at any of step S27 to step S29 (voice outputting means). An example of voice guidance outputted at this time may be "Touch the handle to lock the door."

As described above, the position of key 2 (portable unit 30) is detected and voice guidance is outputted in the position corresponding to the result of this detection. Thus, voice guidance can be outputted in a position in proximity to the user.

At step S37, the CPU 16*a* checks whether the user's operation was detected by the touch sensor 13 to check whether the user appropriately operated the smart entry system. When it determines that the user's operation was detected by the touch sensor 13, it proceeds to step S38. When it determines that the user's operation was not detected by the touch sensor 13, it proceeds to step S40 (operation result checking means). The smart entry system in this embodiment is so constructed that when the result of verification of the portable unit 30 is OK, the door is locked by touching the touch sensor 13 provided on each door. Therefore, it can be determined whether the user appropriately operated the smart entry system according to whether the user's operation was detected by the touch sensor 13 at step S37.

At step S38, the CPU 16*a* assumes that the user appropriately operated the smart entry system and stores the learning history in the memory 16*b* in correlation to key 2 (determination result storing means). At step S39, the CPU 16*a* actuates the door ECU and locking mechanism of each door to lock the door.

At step S40, the CPU 16*a* checks whether a time-out has occurred according to whether a predetermined time has passed after the result of verification was determined as OK at step S23. When the predetermined time has passed and the CPU determines that a time-out has occurred, it proceeds to step S41. When the predetermined time has not passed yet and the CPU determines that a time-out has not occurred, it returns to step S37. When the predetermined time has passed after the result of verification was determined as OK and a time-out has occurred, the CPU 16*a* performs the following processing at step S41. It assumes that the user did not appropriately operate the smart entry system (made an erroneous operation) and erases the learning history from the memory 16*b*. When the learning history is not stored in the memory 16*b*, it does not store a learning history in the memory 16*b* and terminates this series of processing.

If the user appropriately operated the smart entry system, as described above, a learning history is stored in the memory 16*b*. If not, a learning history stored in the memory 16*b* is erased. This makes it possible to disable the next voice guidance for a user who can appropriately operate the smart entry system and provide voice guidance only for a user who cannot. Thus, appropriate voice guidance can be provided.

Even a user who has appropriately operated the smart entry system once may make a mistake in any of the next and following operations. To cope with this, the following may be implemented by erasing a learning history stored in the memory 16*b* as illustrated at step S41: voice guidance is provided when a user made a mistake in operation and thereafter attempts to operate the smart entry system.

In the description of the first embodiment, a voice guidance system for a vehicle that provides voice guidance about operation procedures (especially, door locking operation) for the smart entry system has been taken as an example of the in-vehicle system. The invention is not especially limited to this.

In the above example, customization (setting by a user or the like), learning (the presence or absence of a learning history), and an environment (time, location, noise) are used as a means for changing the mode of voice guidance. Instead, each of them may be solely conducted.

For example, the mode of voice guidance may be changed only based on a learning history. In this case, the voice guidance system for a vehicle includes: a use checking means that determines whether the in-vehicle system is to be used; a voice outputting means that outputs voice guidance; an operation result checking means that checks whether a user performed predetermined operation with the in-vehicle system; a determination result storing means that stores the result of determination by the operation result checking means; and a changing means. When the use checking means determines that the in-vehicle system will be used, the changing means operates as follows: when it is not stored in the determination result storing means that the user performed the predetermined operation, it causes the voice outputting means to output voice guidance; and when it is stored in the determination result storing means that the user performed the predetermined operation, it prevents the voice outputting means from outputting voice guidance.

Figure 3:
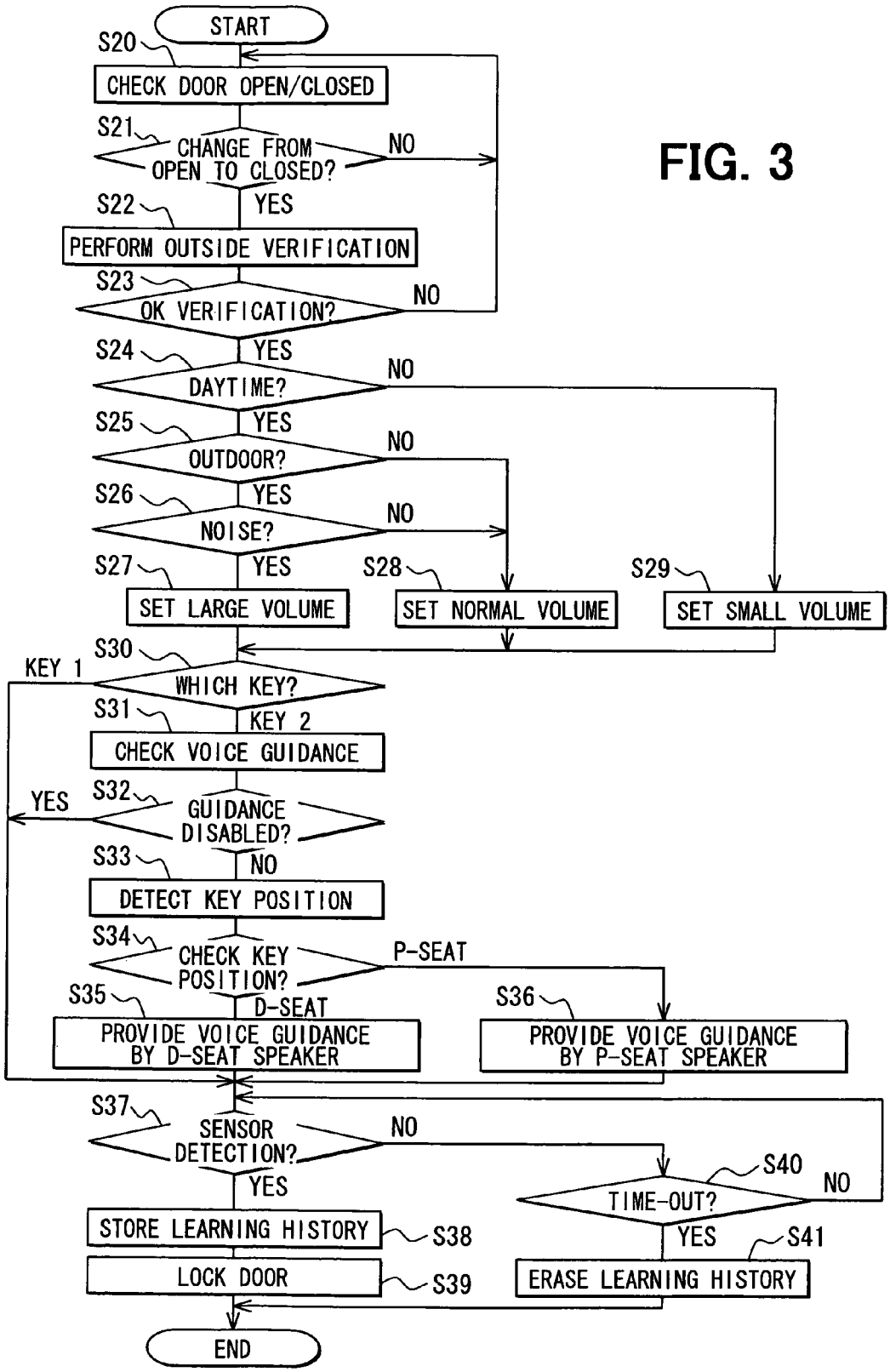
FIG. 3 is a flowchart illustrating the operation and processing performed by a voice guidance system for a vehicle in door lock processing in a smart entry system in the first embodiment.

For instance, when the result of verification is determined as OK at step S23 in FIG. 3, the CPU proceeds to step S32 and checks whether voice guidance is disabled at step S32. When voice guidance is disabled (when a learning history is stored in the memory 16*b*), voice guidance is not provided. When voice guidance is not disabled (when a learning history is not stored in the memory 16*b*), voice guidance is provided by using a speaker (D-seat speaker 18, P-seat speaker 19).

The mode of voice guidance may be changed only based on setting made by a user or the like. In this case, the voice guidance system for a vehicle includes: a use checking means that determines whether the in-vehicle system is to be used; a voice outputting means that outputs voice guidance; and a changing means. When the use checking means determines that the in-vehicle system will be used, the changing means changes the mode of voice guidance outputted by the voice outputting means from portable unit to portable unit. For example, in the procedure illustrated in FIG. 3, the mode of voice guidance is set with respect to each key. When the result of verification is determined as OK at step S23, the CPU proceeds to step S30. At step S30, the key is determined and voice guidance is provided based on the mode of voice guidance set for the key.

The mode of voice guidance may be changed only based on the environment. In this case, the voice guidance system for a vehicle includes: a use checking means that determines whether the in-vehicle system is to be used; a voice outputting means that outputs voice for voice guidance; an environment determining means that determines the environment around the vehicle mounted with the in-vehicle system; and a changing means. When the use checking means determines that the in-vehicle system will be used, the changing means varies the sound volume of voice guidance outputted by the voice outputting means based on the result of determination by the environment determining means. For example, an ECU, a position detector, a map storage device, a speaker, a microphone, and the like may be provided as the voice guidance system for a vehicle. The ECU determines whether the in-vehicle system is to be used and determines the environment around the vehicle by the position detector, map storage device, microphone, clock internal to the ECU, and the like as illustrated at step S24 to step S26. The voice outputting means that outputs voice for voice guidance varies the sound volume of voice guidance outputted from the speaker based on the result of determination of the ambient environment, when it is determined that the in-vehicle system will be used.

In this embodiment, the smart ECU 16 and the voice ECU 17 are constructed as separate ECUs. Instead, only one ECU provided with the functions of the smart ECU 16 and the voice ECU 17 by integrating the smart ECU 16 and the voice ECU 17 may be used.

Second Embodiment

A voice guidance system for a vehicle according to a second embodiment is constructed as in the first embodiment. However, this voice guidance system for a vehicle is provided by connecting a start switch (start SW), a brake switch (brake SW), and the like to the smart ECU 16 in the block diagram of FIG. 1.

The start SW is provided in the vehicle compartment and is operated by a user. It outputs a signal indicating that it has been operated by a user to the smart ECU 16. The brake SW is provided in the vehicle compartment and is operated by a user. It outputs a signal indicating whether a brake pedal (not shown) has been operated by a user.

Figure 4:
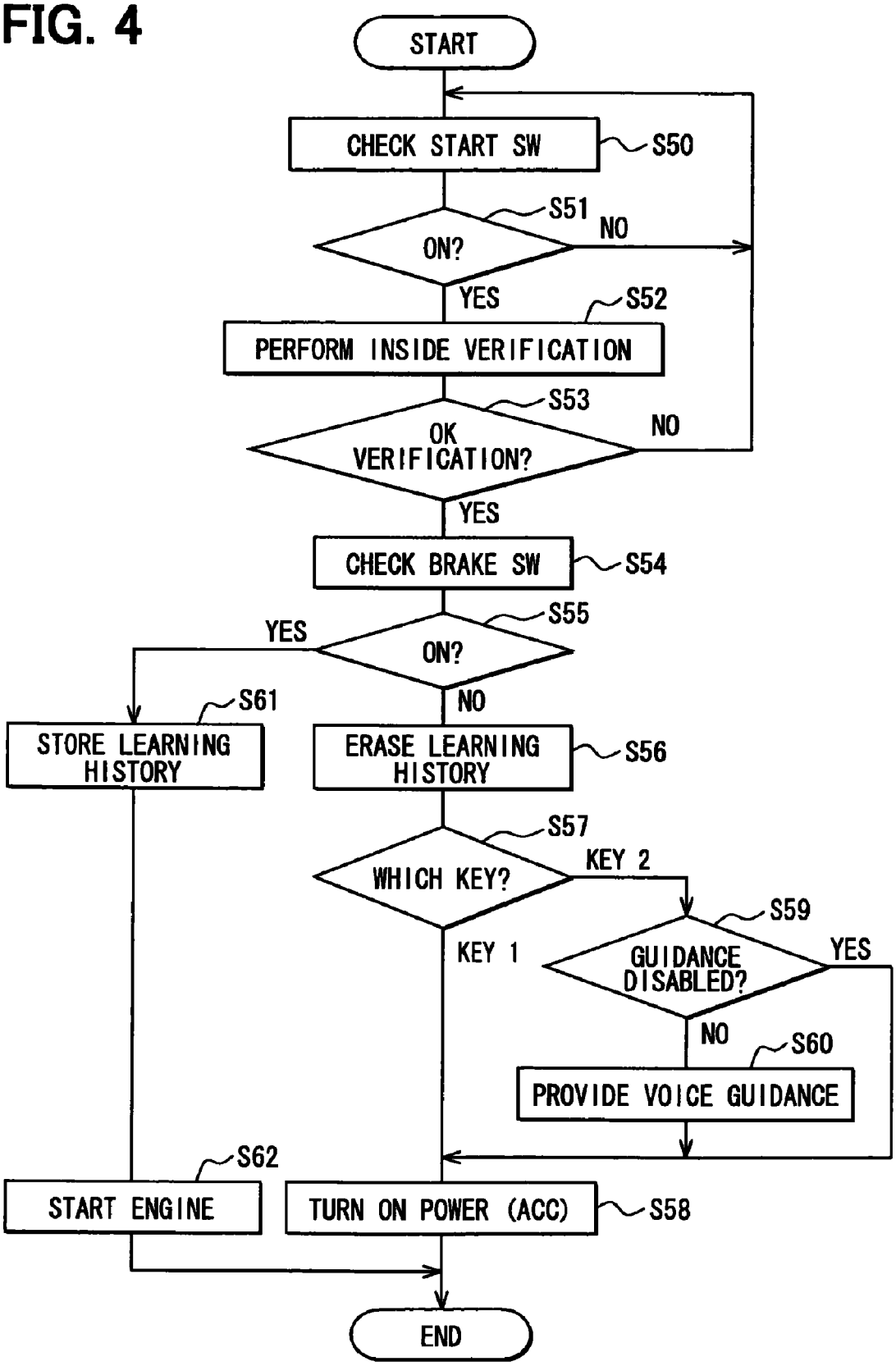
FIG. 4 is a flowchart illustrating the operation and processing performed by a voice guidance system for a vehicle in power supply control processing in a smart entry system according to a second embodiment of the present invention.

The operation and processing performed by the voice guidance system for a vehicle in door locking processing in the smart entry system will be described with reference to FIG. 4.

At step S50, the CPU 16*a* checks a signal from the start SW to check whether the start SW has been turned on. At step S51, the CPU 16*a* checks whether the start SW is ON based on the processing at step S50. When it determines that the start SW is ON, it proceeds to step S52. When it determines that the switch SW is not ON, it returns to step S50.

At step S52, the CPU 16*a* performs inside verification. More specifically, the CPU 16*a* causes an inside transmitter (not shown) to transmit a request signal and further causes the tuner 12 to receive a response signal from the portable unit 30. Then, it performs verification based on the ID code contained in the received response signal. When at step S53, the CPU 16*a* determines that the result of the verification performed at step S52 is OK (the ID code contained in the received response signal meets the predetermined correspondence relation), it proceeds to step S54. When it determines that the result of the verification is not OK, it returns to step S50.

At step S54, the CPU 16*a* checks a signal from the brake SW to determine whether the brake pedal has been operated. At step S55, the CPU 16*a* checks whether the brake SW is ON based on the processing at step S54. When it determines that the brake SW is ON, it proceeds to step S61. When it determines that the brake SW is not ON, it proceeds to step S56.

When the start SW is ON, the result of inside verification is OK, and the brake SW is ON, as described above, the CPU

16*a* assumes that the smart entry system will be used. That is, the CPU 16*a* determines whether the smart entry system is to be used (use checking means) according to the following: whether the start SW is ON; whether the result of inside verification is OK; and whether the brake SW is ON.

At step S56, the CPU 16*a* assumes that the user did not appropriately operate the smart entry system (made a mistake in operation) and erases the learning history from the memory 16*b*. When the learning history is not stored in the memory 16*b*, it does not store a learning history in the memory 16*b* and proceeds to step S57.

At step S57, the CPU 16*a* checks whether the portable unit that transmitted the response signal in the verification performed at step S52 is the main key (key 1) or the sub key (key 2). In this embodiment, the mode of voice guidance can be changed (customized) from portable unit to portable unit. Therefore, the purpose of the determination made at step S57 is to determine the mode of voice guidance corresponding to the portable unit used this time.

In this example of this embodiment, the main key (key 1) is so set that voice guidance will not be provided. Therefore, when it is determined at step S57 that the portable unit is key 1, voice guidance is not provided and the CPU proceeds to step S58. In this example of this embodiment, the sub key (key 2) is so set that voice guidance will be provided. Therefore, when it is determined at step S57 that the portable unit is key 2, the CPU proceeds to step S59. As described above, the following is also be implemented in the power supply control processing in the smart entry system: the mode of voice guidance can be changed on a unit-by-unit basis by the user or the like customizing voice guidance with respect to each portable unit. Therefore, it is possible to provide voice guidance appropriate to each user.

At step S58, the CPU 16*a* outputs an instruction signal to turn on power (ACC) to a power supply ECU (not shown). At step S59, the CPU 16*a* checks whether voice guidance is disabled with respect to key 2 by the processing illustrated in the flowchart of FIG. 2. When there is a learning history correlated to key 2 in the memory 16*b*, voice guidance is disabled with respect to key 2. When the CPU determines that voice guidance is disabled with respect to key 2, it does not provide voice guidance and proceeds to step S58. When it determines that voice guidance is not disabled with respect to key 2, it proceeds to step S60 to provide voice guidance.

As described above, the mode of voice guidance can also be changed from portable unit to portable unit by learning (learning history) in the power supply control processing in the smart entry system. Therefore, it is possible to provide voice guidance appropriate to each user. More specifically, in this embodiment, the mode of voice guidance can be changed by customizing voice guidance with respect to each portable unit (key 1, key 2). In addition, the mode of voice guidance can be changed with respect to each portable unit (key 1, key 2) by learning.

At step S60, the CPU 16*a* outputs an instruction signal to the voice ECU 17 and thereby causes the D-seat speaker 18 to output voice guidance (voice outputting means). An example of voice guidance provided at this time is "Step on the brake to operate the start SW."

At step S61, the CPU 16*a* assumes that the user appropriately operated the smart entry system and stores a learning history in the memory 16*b* (determination result storing means). At step S62, the CPU 16*a* outputs an instruction signal to start the engine to an engine ECU (not shown).

When the user appropriately operates the smart entry system, as described above, a learning history is stored in the memory 16*b*. When not so, a learning history stored in the memory 16*b* is erased. This makes it possible to disable the next voice guidance for a user who can appropriately operate the smart entry system and provide voice guidance only for a user who cannot. Thus, appropriate voice guidance can be provided.

What is claimed is:

1. A voice guidance system for a vehicle providing voice guidance about operation procedures for an in-vehicle system, said voice guidance system comprising:

a use checking means for checking whether an in-vehicle system will be used;

a voice outputting means for outputting voice guidance about a predetermined operation required to use the in-vehicle system;

an operation result checking means for checking whether a user has performed said predetermined operation on the in-vehicle system;

a determination result storing means for storing a determined result of the operation result checking means; and a changing means for, when the use checking means determines that the in-vehicle system will be used, causing the voice outputting means to output the voice guidance if the stored determination indicates that the user has not previously performed the predetermined operation and causes the voice outputting means not to output the voice guidance if the stored determination result indicates that the user has previously performed the predetermined operation, wherein the determination result storing means erases a stored determination result indicating that a user has performed the predetermined operation in the past when the operation result checking means determines that the user has currently failed to perform the predetermined operation.

2. The voice guidance system for a vehicle according to claim 1, further comprising:

an environment determining means for determining ambient environment of the in-vehicle system, wherein the changing means changes sound volume of voice guidance outputted by the voice outputting means based on a determined result of the environment determining means.

3. The voice guidance system for a vehicle according to claim 1, wherein:

the in-vehicle system is configured to intercommunicate with a plurality of portable units which send back response signals containing respective different ID codes in response to a request signal transmitted from a vehicle unit, and the vehicle unit thereby receives a response signal from any one of the plurality of portable units, verifies the ID code contained in the response signal against pre-registered codes, and controls vehicle-mounted equipment according to a result of the verification;

the determination result storing means stores the determined result of the operation result checking means for each portable unit; and when the use checking means determines that the in-vehicle system will be used, the changing means causes the voice outputting means to output voice guidance if the stored determination result for a corresponding portable unit indicates that a user has not performed the predetermined operation, and not to output voice guidance if the stored determination result for that portable unit indicates that the user has previously performed the predetermined operation.

4. The voice guidance system for a vehicle according to claim 1, further comprising:

an environment determining means for determining ambient environment of the in-vehicle system; and a changing means for varying, when the use checking means determines that the in-vehicle system will be used, sound volume of voice guidance outputted by the voice outputting means based on a determined result of the environment determining means.

* * * * *